US010415175B2

(12) United States Patent
Chou et al.

(10) Patent No.: US 10,415,175 B2
(45) Date of Patent: Sep. 17, 2019

(54) ROTARY COMPRESSOR, HEAT PUMP, AND HOUSEHOLD APPLIANCE

(71) Applicants: BSH HAUSGERÄTE GmbH, München (DE); RECHI PRECISION CO., LTD, Taoyuan, Hsien (TW)

(72) Inventors: Chien Chung Chou, Taoyuan Hsien (TW); Javier Nagore Iriarte, Olloki (ES); Iñaki Otero Garcia, Villaba (ES); Jose Antonio Ruiz Bermejo, Alfaro (ES); Roberto San Martin Sancho, Estella (ES)

(73) Assignees: BSH Hausgeräte GmbH, Munich (DE); RECHI PRECISION CO., LTD, Taoyuan Hsien (TW)

( * ) Notice: Subject to any disclaimer, the term of this patent is extended or adjusted under 35 U.S.C. 154(b) by 101 days.

(21) Appl. No.: 15/503,121

(22) PCT Filed: Aug. 14, 2015

(86) PCT No.: PCT/EP2015/068732
§ 371 (c)(1),
(2) Date: Feb. 10, 2017

(87) PCT Pub. No.: WO2016/024009
PCT Pub. Date: Feb. 18, 2016

(65) Prior Publication Data

US 2017/0226685 A1 Aug. 10, 2017

(30) Foreign Application Priority Data

Aug. 14, 2014 (EP) ..... 14382314

(51) Int. Cl.
*F03C 2/00* (2006.01)
*F03C 4/00* (2006.01)
(Continued)

(52) U.S. Cl.
CPC ..... *D06F 58/206* (2013.01); *D06F 39/04* (2013.01); *F04C 18/356* (2013.01);
(Continued)

(58) Field of Classification Search
CPC ..... D06F 58/206; D06F 58/20; D06F 58/24; D06F 39/04; F04C 18/356; F04C 18/3564;
(Continued)

(56) References Cited

U.S. PATENT DOCUMENTS

2010/0275457 A1 11/2010 Balerdi Azpilicueta et al.

FOREIGN PATENT DOCUMENTS

EP 1 405 946 4/2004
EP 2 067 890 6/2009
(Continued)

*Primary Examiner* — Theresa Trieu
(74) *Attorney, Agent, or Firm* — Nixon & Vanderhye P.C.

(57) ABSTRACT

A rotary compressor includes a cylindrical housing, a cylindrical roller accommodated in the housing, a motor shaft leading through the roller having a cam for rolling the roller along a side wall of the housing, and a discharge port leading through a bottom cover, wherein a height-to-radius ratio of the roller is between 6 and 1.2, a radius of the motor shaft is 8.0 mm or less, a cam height of 14 mm or less, an area of the discharge port of 17 $mm^2$ or more, and a thickness of the discharge port of 2.5 mm or less. For operation of the compressor, a top cover may be put onto the top open side of the housing. The top cover may have a bushing for the shaft. A heat pump includes the compressor. A household appliance, in particular laundry care apparatus, includes the heat pump.

13 Claims, 2 Drawing Sheets

(51) Int. Cl.

| | |
|---|---|
| ***F04C 2/00*** | (2006.01) |
| ***D06F 58/20*** | (2006.01) |
| ***F04C 18/356*** | (2006.01) |
| ***D06F 39/04*** | (2006.01) |
| *D06F 58/24* | (2006.01) |

(52) U.S. Cl.
CPC ..... *F04C 18/3564* (2013.01); *D06F 58/20* (2013.01); *D06F 58/24* (2013.01); *F04C 2210/266* (2013.01); *F04C 2250/00* (2013.01)

(58) Field of Classification Search
CPC ..... F04C 11/001; F04C 23/008; F04C 29/04; F04C 2210/266; F04C 2250/00; F04C 2250/102
USPC ..... 418/11, 60, 63, 83, 178–179
See application file for complete search history.

(56) References Cited

FOREIGN PATENT DOCUMENTS

| | | | |
|---|---|---|---|
| EP | 2 644 768 | | 10/2013 |
| JP | 58-197493 | A | 11/1983 |
| JP | 2007-132619 | A | 5/2007 |
| JP | 2007-198319 | A | 8/2007 |
| JP | 2009-235969 | A | 10/2009 |
| WO | WO 2007/114135 | A1 | 10/2007 |

ROTARY COMPRESSOR, HEAT PUMP, AND HOUSEHOLD APPLIANCE

This application is the U.S. national phase of International Application No. PCT/EP2015/068732 filed 14 Aug. 2015, which designated the U.S. and claims priority to EP Patent Application No. 14382314.4 filed 14 Aug. 2014, the entire contents of each of which are hereby incorporated by reference.

The invention relates to a rotary compressor, comprising a cylindrical housing having a first longitudinal axis, a cylindrical roller having a second longitudinal axis and accommodated in the housing such that the second longitudinal axis is aligned parallel and spaced apart from the first longitudinal axis, a rotatable motor shaft leading through the roller having a cam for rolling the roller along a side wall of the housing, a discharge port leading through a bottom cover. The invention also relates to a heat pump for a household appliance, comprising such compressor, a condenser, a restrictor, and an evaporator. The invention further relates to a household appliance, in particular laundry care apparatus, comprising such heat pump.

BACKGROUND

A laundry dryer having a heat pump typically comprises a refrigerant circuit and an air path. The refrigerant circuit comprises a compressor, a condenser, a restrictor and an evaporator which are connected in series by refrigerant lines. The refrigerant flows through the compressor, the condenser, the restrictor and the evaporator, in this order. The refrigerant releases heat to the process air flowing through the air path by means of the condenser and extracts heat and humidity from the process air flowing through the air path by means of the evaporator. The compressor absorbs power and compresses the refrigerant in the refrigerant circuit.

Within the air path or process air circuit, process air flows from a drum to the evaporator. At a drum outlet, the air is at a medium temperature and relatively wet. At the evaporator, the air is cooled and dehumidified and then flows to the condenser where it is heated. Hot and dry air is then introduced again in the drum where it can absorb moisture from laundry contained in the drum. The evaporator and the condenser are thus acting as heat exchangers having a refrigerant side and a process air side. The use of a heat pump in clothes dryers and its general layout is well-known in the art, as shown e.g. in the documents EP 2 132 370 B1, EP 2 212 463 B1, U.S. Pat. No. 8,356,423 B2, EP 1 632 736 A2, EP 1 593 770 B1, WO 2013/060626 A1, WO 2013/023958 A1, WO 2012/065916 A1, WO 2011/080045 A1, US 2010/0154248 A1, and US 2011/0209484 A1.

A laundry dryer comprising a heat pump has an improved efficiency in use of energy (e.g., in terms of kWh/kg) as compared to a conventional laundry dryer only employing an electrical heater. Thus, in principle, a related operational carbon dioxide emission of the laundry dryer comprising the heat pump is lower than that of the conventional dryer due to its lower electric consumption. However, a refrigerant used in the heat pump must be taken into account with its GWP ('Global Warming Potential'). Nowadays, typical refrigerants used in a heat pump are fluorinated hydrocarbon compounds (HFC) like R407C and R134a whose GWP is higher than 1300.

One possibility to reduce TEWI ('Total Equivalent Warming Impact', that includes direct and indirect emission) of these systems is to use hydrocarbon refrigerants that have a low GWP like R-290 (propane) and R-1270 (propylene).

The main drawback of these refrigerants is that they are flammable and therefore the IEC 60335-2-11 standard limits their maximum charge to 150 g per laundry dryer. It is generally known that an optimum refrigerant charge can be found for a specific system, but the refrigerant limit of 150 g imposed by the IEC 60335-2-11 standard is typically lower than an optimum charge of refrigerant for a conventional heat pump of a laundry dryer.

Efficiency is also affected by the compressor. For example, the efficiency of a rotary compressor is affected by the geometries of its components. The variation of these geometries implies differences in mechanical frictions and in the thermodynamic behaviour of the refrigerant inside the compressor. In more detail, the losses in the compressor that determine its efficiency include the following: energy losses stemming from a motor loss, friction losses, a compression loss due to a not ideal compression, a valve loss due to gas pulsations and an over-compression, and a lubricant pumping loss, as well as mass flow losses stemming from a clearance volume loss due to valve and cylinder head dimensions, a leakage loss, a back-flow-loss, a suction gas heating loss due to a gas density at a cylinder inlet, and a loss due to lubricant flow.

Rotary compressors or "scroll-type" compressors are e.g. described in the documents U.S. Pat. No. 7,029,251 B2, U.S. Pat. No. 6,796,779 B1, U.S. Pat. No. 6,672,852 B1, and U.S. Pat. No. 6,413,060 B1.

SUMMARY

It is an object of the current invention to at least partially overcome at least some of the problems of the art, in particular with respect to heat pumps for household appliances, in particular clothes treatment appliances, to particularly provide a rotary compressor for or of heat pump for a household appliance, in particular a clothes treatment appliance, which achieves a reduced GWP and an improved efficiency.

According to the invention, this object is achieved by the features of the independent claims. Preferred embodiments are particularly referred to by the dependent claims, outlined by the subsequent description and shown in the attached drawing.

Therefore, the object is achieved by a rotary compressor, comprising a cylindrical housing having a first longitudinal axis, a cylindrical roller having a second longitudinal axis and accommodated in the housing such that the second longitudinal axis is aligned parallel and spaced apart from the first longitudinal axis, a rotatable motor shaft leading through the roller having a cam for rolling the roller along a side wall of the housing, and a discharge port leading through a bottom cover, wherein a height-to-radius ratio of the roller is between 1.6 and 1.2, a radius of the motor shaft is 8 mm or less, a height of the cam is 14 mm or less, and an effective area of the discharge port is 17 $mm^2$ or more, and a thickness of the discharge port that is 2.5 mm or less.

The height-to-radius ratio, the shaft radius and the cam height in their functional interaction lead to significantly reduced friction losses and therefore increase an operational efficiency of the compressor. This may e.g. be used to reach the same cooling capacity as with known rotary compressors but with a lower power input. In particular, a reduction in the height-to-radius ratio gives a reduction in friction losses of the roller. A reduction of the shaft radius gives a reduction in the friction losses due to a smaller contact or friction surface and also due to a lower linear velocity at this friction surface. A reduction of the cam height gives a reduction in friction losses due to a smaller friction area.

In functional interaction or combination with these friction-reducing dimensions, the now relatively large area of the discharge port reduces a pressure drop when refrigerant is passing through the valve. This reduces energy losses and further increases the operational efficiency of the compressor. The relatively small thickness of the discharge port reduces—in functional combination with the other features—the volumetric losses due to a smaller dead volume and thus further increases the volumetric efficiency of the compressor.

In combination, a significantly improved efficiency and/or a lower value of TEWI (Total Equivalent Warming Impact) can be achieved by operating this compressor with flammable refrigerants, like R290 and R1270. And improvement in efficiency may also be achieved by operating with standard HFC refrigerants such as R407C.

The housing may also be regarded as a crankcase.

A lower end face or bottom face of the roller may in particular glide over a bottom wall of a bottom cover of the housing. An upper end face or top face of the roller may in particular glide relative to and in contact with a top cover of the housing. The top face of the roller and the top cover of the housing, and the bottom face of the roller and the top cover, thus constitute respective associated friction surfaces. The top cover may have a bushing for the shaft.

The cam may be regarded as a cam portion or eccentric portion of the shaft. The cam may press the roller onto a side wall of the housing. The height of the cam of 14 mm may be measured at a side wall of the cam that is also used as a contact or friction surface to the inner side wall of the housing. In this regard, the height of the cam is equivalent to a height of a contact/friction line or contact/friction area between the cam and the inner side wall of the roller.

The discharge port may be leading through the bottom cover. A thickness of the discharge port is then equivalent to a height of the bottom cover around the discharge port.

A radius of the roller and a radius of the shaft may in particular be measured to an outer surface of the roller and the shaft, respectively.

An effective area of the discharge port may in particular be the area that is not covered by the housing. If the discharge port is not covered it is equal to the full area. In particular the discharge port may be provided by cutting out the respective area from the housing.

It is an advantageous embodiment that the compressor comprises a bearing between the cam (portion of the shaft) and the roller. This can further reduce friction losses. It is also an advantageous embodiment that the compressor comprises a bearing between the shaft and the roller. The shaft then does not need to have a cam portion anymore, or the bearing is used as a cam. This may also reduce friction losses.

It is an advantageous embodiment that a displacement of the compressor is in a range from 6 cc to 9.5 cc, in particular in a range from 7.9 cc to 8.3 cc, in particular at 8.1 cc. If the compressor displacement is determined to be bigger than 9.5 cc, an increase of a heat capacity at the condenser might be required in order to enable proper dissipation of energy that has been transferred from the compressor. To increase the heat capacity, however, a larger area and volume of the condenser might be required. In turn, it would be required to increase the refrigerant charge in order to enable a condensation of the refrigerant in the condenser. But this often is not possible due to the stated dryer safety standard limitation of 150 g for flammable refrigerants. If, on the other hand, the compressor displacement is smaller than 6 cc, the refrigerant mass flow rate might decrease which could negatively affect energy transfer within the heat exchangers.

It is an advantageous embodiment that the height of the cam is 12.8 mm or less. This gives a surprisingly strong reduction in friction losses.

It is an advantageous embodiment that the effective area of the discharge port is 17 $mm^2$ or more. This gives a particularly strong reduction of the pressure drop.

Generally, the largest part of the refrigerant resides in the condenser and in the compressor (there as a mix of refrigerant with oil). The fraction of the refrigerant which is dissolved in the oil inside the compressor is not available in the heat exchangers for energy transfer purpose. Therefore, the higher the amount of refrigerant that is dissolved in the oil inside the compressor, the less amount of refrigerant is available in heat exchangers (condenser, evaporator) to reach the optimum working point because of the limitation to 150 g of flammable refrigerants according to dryer standard IEC 60335-2-11. Thus, the solubility of the refrigerant in the oil influences effectiveness of the compressor and of the heat pump.

With systems that are not equipped with an oil-separation capability, the lubricant/oil carried over from the compressor into the evaporator must be sufficiently miscible with the refrigerant at the evaporation temperature so that the refrigerant-oil-blend remains in one phase after expansion in the evaporator, and at a sufficiently low viscosity to travel along the heat exchanger back to the compressor. If the oil separates in the evaporator due to a poor miscibility with the refrigerant fluid, or if the blend viscosity is too high, oil or blend of oil and refrigerant is likely to get trapped in the evaporator. This adversely affects the cooling capacity and efficiency of the heat pump.

Further, kinematic viscosity of the oil should be sufficient for effective lubrication of the compressor even after absorption of gaseous refrigerant at the compressor temperature to keep friction losses low. It was found that especially for low density refrigerants, as R290, an overall benefit can be obtained by an increased kinematic viscosity due to an improvement of compressor volumetric efficiency, altogether leading to surprisingly higher compressor efficiency.

Preferred for use in the compressor are Polyalkylene Glycols ("PAG") and Polyolester Oils ("POE"). It is a particularly preferred embodiment that a PAG type oil used in the compressor has a kinematic viscosity between 95 and 105 cSt, each at 40° C. It is another particular embodiment that a POE type oil used in the compressor has a kinematic viscosity between 60 and 105 cSt, each at 40° C.

It is an advantageous embodiment that the rotary compressor comprises an oil of the type PAG PZ100S (from Idemitsu Kosan Co., Ltd.) having a kinematic viscosity at 40° C. of 100 $mm^2/s$ or cSt for pure oil, POE RB-P68EP (from JX Nippon Oil & Energy Corporation), having a kinematic viscosity of 68 cSt, or POE RP-100EP (from JX Nippon Oil & Energy Corporation) having a kinematic viscosity of 100 cSt, or equivalents thereof. They support a long lifetime of the compressor and an advantageous miscibility with a refrigerant (e.g. R290) to achieve an efficient working point of the heat pump. These oils also have the advantage that they exhibit advantageous values of oil kinematic viscosity that are preferred in order to assure good internal leakage sealing in order to improve compressor volumetric efficiency and therefore improve compressor efficiency. They have the additional advantage that they have a relatively low solubility with the refrigerant compared to other typically used oils of the same types, like POE RB-68EP in heat pump dryer compressors.

To also achieve or to support the above mentioned advantages of the invention, a mixture viscosity of the oil is taken into account. A mixture viscosity between 1.5 $mm^2/s$ (cSt) and 4 $mm^2/s$ is preferred, in particular at the heat pump dryer working point. The heat pump dryer working point may have a pressure of about 26 bar (i.e. condensation pressure at 70° C.) and a mix temperature of oil and refrigerant of 80° C. in the compressor. That range of viscosity with higher values than previously used oils is preferred in order to assure good internal leakage sealing in the compressor (which is particularly preferred due to low density of R290) and therefore to improve compressor volumetric efficiency.

Table 1 shows a comparison among the oils mentioned, now mixed with R290:

| Oil | Mass of R290 in the Mixture (%) | Refrigerant Mass in Mixture (g) | Mixture Viscosity ($mm^2/s$ or cSt) |
|---|---|---|---|
| PAG PZ46M | 18 | 32.08 | 2.7 |
| PAG PZ100S | 30 | 53.46 | 3.8 |
| POE RB-68EP | 27 | 48.36 | 1.12 |
| POE RB-P68EP | 24 | 42.98 | 1.6 |
| POE RP-100EP | 17.8 | 32.29 | 3.67 |
| Mineral NM80EP | 30 | 48.60 | 1.2 |
| POE EXP-4437 | 33 | 59.10 | 0.45 |

The values refer to a pressure of about 26 bar and a mix temperature in the compressor with refrigerant R290 of 80° C.

It is an advantageous embodiment that an oil quantity in the compressor is between 150 cc and 210 cc, in particular 180 cc or less.

It is an advantageous embodiment, in particular for use of R290 as a refrigerant, that a displacement of the compressor is in the range of 7.9 cc to 8.3 cc, in particular at 8.1 cc.

The object is also achieved by a heat pump for a household appliance, in particular laundry care apparatus, comprising a compressor, a condenser, a restrictor, and an evaporator, wherein the compressor is a rotary compressor as described above. The heat pump achieves the same object and the same advantages as the compressor.

It is an advantageous embodiment that a flammable refrigerant is used in the heat pump. In particular, R290 may be used as a refrigerant in a quantity of 150 g or less. As an alternative, R1270 may also be used as a flammable refrigerant in a quantity as mentioned.

It is an alternatively advantageous embodiment that R407C or R134a is used as a refrigerant.

The object is also achieved by a household appliance comprising a heat pump, wherein the heat pump is a heat pump as described above. The household appliance achieves the same object and the same advantages as heat pump and the compressor described above. In particular the household appliance may achieve operation of the heat pump at higher power, thereby achieving shorter drying time in a drying process, and lower energy consumption overall. The household appliance may be a laundry care apparatus. The laundry care apparatus may be a clothes dryer, in particular a tumble dryer (as a standalone machine or as a combination with a washing machine). The household appliance may also be a washing machine, a cooling machine (a refrigerator etc.) etc.

In case of flammable refrigerants, with the restriction to 150 g, it is not possible anymore to increase the refrigerant amount to improve the system efficiency. Therefore, the use of a relatively low quantity of oil with a convenient relation between (i) its solubility with a refrigerant and (ii) a kinematic viscosity of this mixture can lead to higher refrigerant mass flow rates in the heat pump comprising this compressor at a given compressor power consumption. Thus, the efficiency of such a heat pump improves due to a higher amount of available refrigerant (effective refrigerant) travelling through the heat exchangers, and enhances heat exchange properties and yields shorter drying times.

It is an advantageous embodiment that the laundry care apparatus comprises a tumble dryer function.

An advantageous embodiment is the use of Propane (R290) as a refrigerant in conjunction with a rotary compressor with displacement smaller than 9.5 cc and higher than 6 cc, a roller with a height-to-radius ratio between 1.6 and 1.2, a shaft radius smaller than 8.0 mm, a cam height lower than 14 mm, an effective discharge port area larger than 17 $mm^2$, a discharge port thickness lower than 2.5 mm, a use of PAG PZ100S or POE RB-P68EP, or POE RP-100EP, or an equivalent of one of these, as oil, and a quantity of the oil of less than 210 cc.

It is another advantageous embodiment to use another flammable refrigerant instead of R290, in particular R 1270, in particular for use in a heat pump, in particular in a household appliance, in particular in a tumble dryer.

It is another advantageous embodiment to use HFC refrigerant R407C instead of R290, in particular for use in a heat pump, in particular in a household appliance, in particular in a tumble dryer.

BRIEF DESCRIPTION OF THE DRAWINGS

In the figures of the attached drawing, the invention is highlighted by means of an exemplary embodiment schematically shown, and will be explained further subsequently with reference to that exemplary embodiment. In particular.

DETAILED DESCRIPTION

Figure 1:
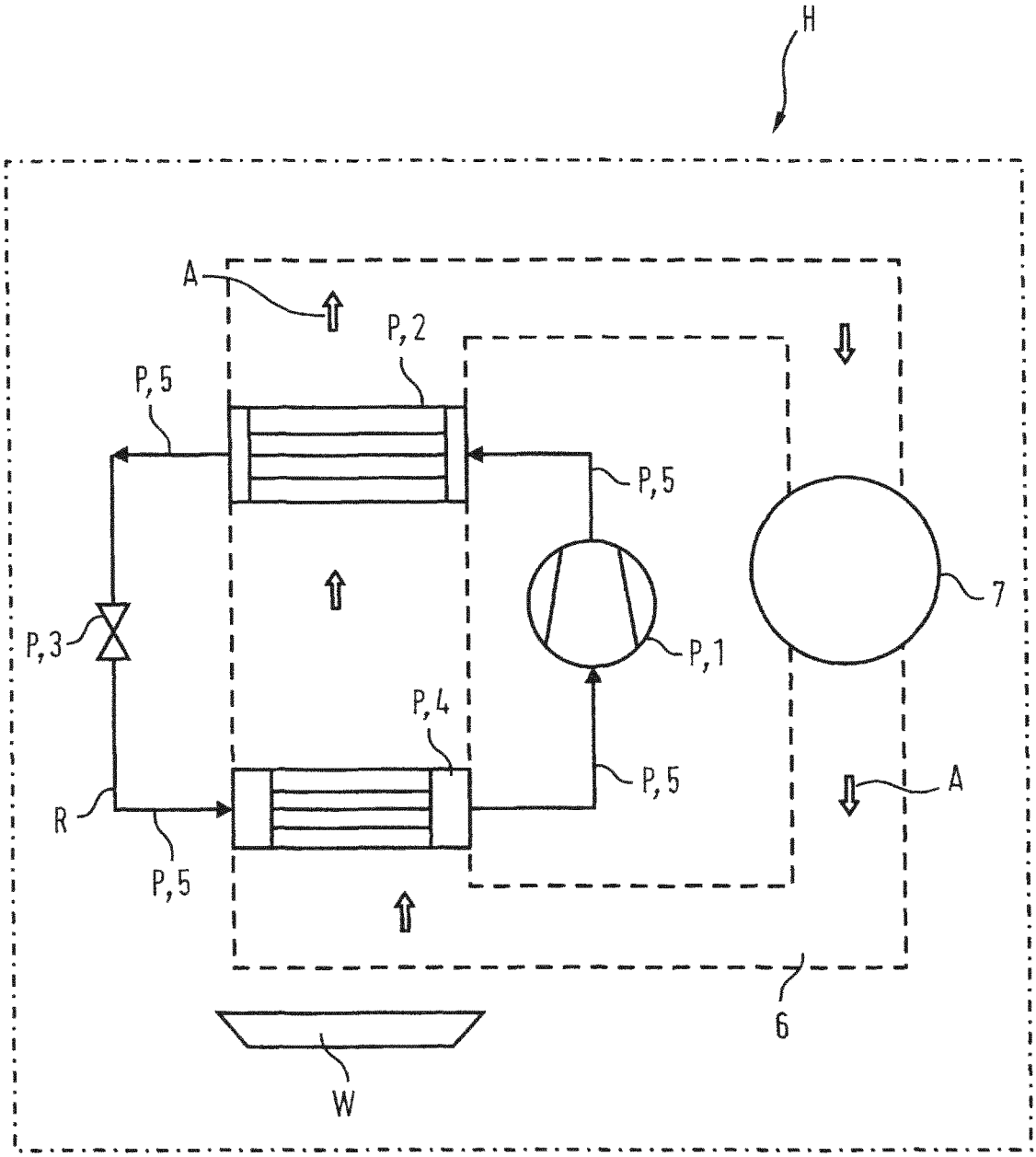
FIG. 1 shows a schematic drawing of a household tumble dryer using a heat pump.

FIG. 1 shows a clothes treatment appliance in form of a household tumble dryer H. The tumble dryer H comprises a heat pump P having at least a compressor 1, a condenser 2 (e.g. of a tube-and-fins type), a restrictor 3 (e.g. a valve), and an evaporator 4 (e.g. of a tube-and-fins type) as elements. The elements 1 to 4 are serially connected in the shown order by refrigerant pipes 5 to form a refrigerant circuit or path.

The tumble dryer H also comprises a process air circuit or path 6 wherein process air A flows. The air circuit 6 comprises a rotatable drum 7 for holding to be processed clothes. The air A leaves the drum 7 at a medium temperature and wet. The air A then flows to the evaporator 4 that is placed in the air circuit 6 downstream the drum 7 and works as a heat exchanger. At the evaporator 4, the air A is cooled down and condenses. The resultant condensate is collected in a water tank W. At the evaporator 4, the air A also cools down and transfers part of its thermal energy upon the evaporator 4 and thus onto the refrigerant R within the evaporator 4. This enables the evaporator 4 to transform the refrigerant R from a liquid state into a vaporous state.

Further downstream the air circuit 6 the now dry and cool air A passes through the condenser 2 where a heat transfer from the condenser 2 and the refrigerant R, resp., to the air A is effected to heat up the air A and cool down the refrigerant R to its liquid state. The then warm and dehumidified/dry air A is subsequently reintroduced into the drum 7 to warm up the clothes and to pick up moisture. The refrigerant R is moved within the refrigerant circuit 1 to 5 by the compressor 1. The refrigerant R is a flammable refrigerant, in particularly R290. An amount of the flammable refrigerant R is 150 g or less.

The evaporator 4 and the condenser 2 are thus used as heat exchangers.

The working of such a tumble dryer H with its heat pump P (comprising the refrigerant circuit 1 to 5) and its air circuit 6 is well known and does not need to be explained in greater detail.

Figure 2:
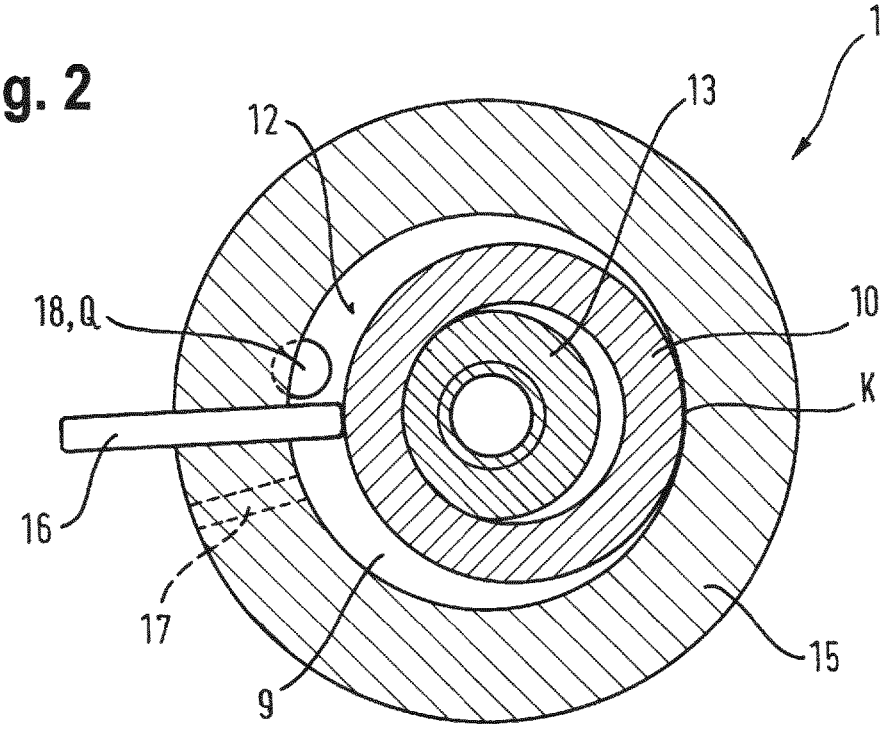
FIG. 2 shows a top view onto an opened rotary compressor.
Figure 3:
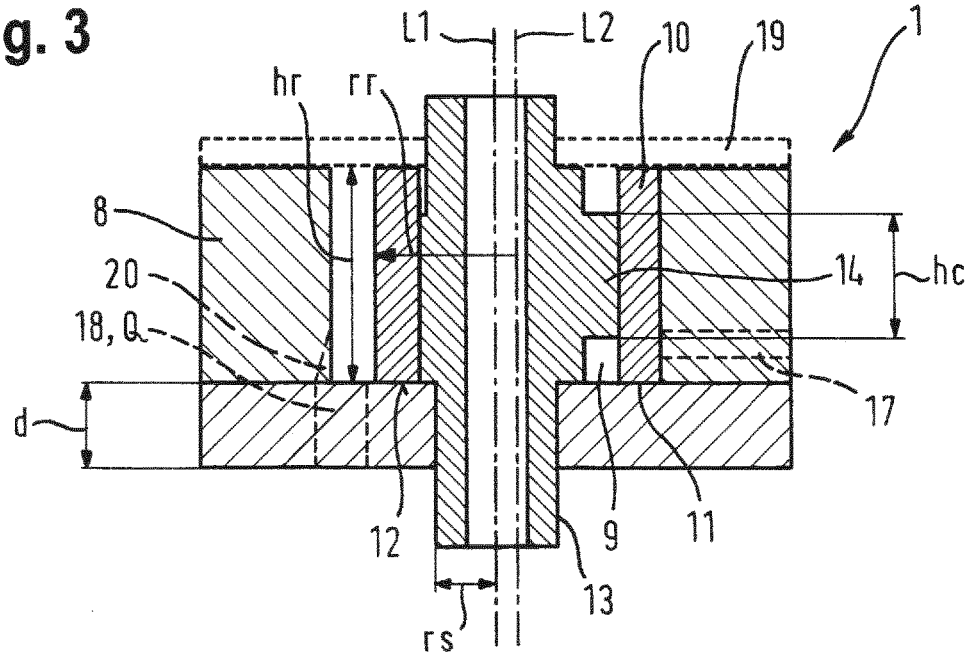
FIG. 3 shows a cross-sectional side view of the opened rotary compressor of FIG. 2.

FIG. 2 shows a top view onto an opened rotary compressor 1 of the household tumble dryer H. FIG. 3 shows a cross-sectional side view of the opened rotary compressor of FIG. 2.

The compressor 1 comprises a hollow cylindrical housing 8 with a cavity 9 which houses a hollow cylindrical roller 10. A lower end face 1 1 of the roller 10 is supported by a bottom cover 12. The lower end face 1 1 of the roller 10 can move or slip along an inner side of the bottom cover 12. A longitudinal axis L1 of the housing 8 and a longitudinal axis L2 of the roller 10 are aligned in parallel but spaced apart. The roller 10 is rollingly rotated within the housing 8 by a shaft 13 that is connected to an electrical motor (not shown). The shaft 13 lies concentric to the housing 8 and is thus eccentric to the roller 10. To be able to rotate the roller 10 within the housing 8, the shaft 13 has a laterally positioned cam 14 or cam portion (only shown in FIG. 3) that presses the roller 10 onto an inner face of a side wall 15 of the housing 8. The roller 10 thus has a contact line K with the side wall 15. When the shaft 13 rotates it rolls the roller 10 along the side wall 15.

A path of the contact line K at the inner side wall 15 then describes a closed loop. A displacement of the compressor 1 for one full rotation of the roller 10 is between 6 cc and 9.5 cc, in particular in the range of 7.9 cc to 8.3 cc, in particular 8.1 cc. A length of the contact line K corresponds to a height hr of the roller 10 at the side wall 15.

The shaft 13 is formed as a hollow cylinder such that is can be connected to an oil pump (not shown) to feed oil into the compressor 1. The oil quantity within the compressor 1 is between 150 cc and 210 cc, preferably 180 cc or less. The oil may in particular be PAG PZ100S, POE RB-P68EP, or POE RP-100EP, or an equivalent.

Into the cavity 9 of the housing 8 protrudes a blade 16 that contacts an outer side face of the roller 10. The housing 8 also has a suction port 17 leading through its wall to suck refrigerant R into the cavity 9 and a discharge port 18 leading through the bottom cover 12 to discharge the refrigerant R. The side wall 15 of the housing 8 has a recessed section 20 adjacent to and above the discharge port 18 to avoid covering the discharge port 18. A cross-sectional area Q of the discharge port 18 is 23 $mm^2$ or more, preferably larger than 28 $mm^2$, preferably 34 $mm^2$ or larger. A thickness d of the discharge port 18 (corresponding to its height along the longitudinal axis L1) is 2.5 mm or less.

For operation of the compressor, a cover lid or top cover 19 (shown as a dashed line) is put onto the open side of the housing 8. The top cover 19 may have a bushing for the shaft 13.

In FIG. 3, a ratio hr/rr of a height hr to a radius rr of the roller 10 (the 'height-to-radius ratio' hr/rr) is between 1.6 and 1.2, preferably less than 1.6.

A radius rs of the shaft 13 (without the cam 14) is 8.0 mm or less.

The internal elements 8, 10 to 14, 16, and 19 of the compressor 1 are moving at different rotation speeds during operation of the compressor 1. This difference in the speed produces friction between these elements 8, 10 to 14, 16, and 19.

The friction losses associated with such friction are produced by two kinds of lubrication (i) hydrodynamic lubrication and (ii) boundary lubrication. With hydrodynamic lubrication, a full film of oil exists between moving contact surfaces. For hydrodynamic lubrication, the friction forces can be calculated considering oil as a Newtonian fluid, i.e. using $F=\mu \cdot A \cdot u/y$, wherein F is a force required to move two parallel surfaces of area A that are separated be a distance y with a constant speed u. $\mu$ represents the dynamic viscosity of the oil between the surfaces ('contact surfaces' or 'friction surfaces'). With boundary lubrication, a thin film of oil is located between moving surfaces. In this case, a direct contact between surfaces is produced. For calculating the respective friction force F, a well-known linear friction law according to $F=\mu \cdot N$ with $\mu$ being a friction coefficient and N being a normal force can be used. Calculation for the compressor 1 confirmed that the compressor 1 has significantly lower friction losses, especially because of a reduction of the friction between the roller 10 and the cam 14 and between the motor shaft 13 and the bottom wall 12 of the housing 8. This is caused by smaller friction areas as well as lower linear velocities between the friction surfaces of the compressor 1.

Of course, the invention is not restricted to the embodiments shown.

LIST OF REFERENCE NUMERALS

1 compressor
2 condenser
3 restrictor
4 evaporator
5 refrigerant pipe
6 air circuit
7 rotatable drum
8 housing
9 cavity
10 roller
11 lower end face of the roller
12 bottom wall of bottom cover
13 shaft
14 cam
15 side wall of the housing
16 blade
17 suction port
18 discharge port
19 top cover
20 recessed section of the housing
A air
d thickness of the discharge port
H tumble dryer
hc height of the cam
hr height of the roller
K contact line
L1 longitudinal axis L1 of the housing
L2 longitudinal axis L2 of the roller
P heat pump Q area of the discharge port
R refrigerant
rr radius of the roller
rs radius of the shaft
W water tank

The invention claimed is:

1. A rotary compressor, comprising a cylindrical housing having a first longitudinal axis, a cylindrical roller having a second longitudinal axis and being accommodated in the housing such that the second longitudinal axis is aligned parallel and spaced apart from the first longitudinal axis, a rotatable motor shaft leading through the roller having a cam for rolling the roller along a side wall of the housing, and a discharge port leading through a bottom cover, wherein a height-to-radius ratio of the roller is between 1.6 and 1.2, a radius of the motor shaft is no more than 8 mm, a height of the cam is no more than 14 mm, an effective area of the discharge port is at least 17 $mm^2$, and a thickness of the discharge port is no more than 2.5 mm.

2. The rotary compressor according to claim 1, wherein a displacement of the compressor is between 6 cc and 9.5 cc.

3. The rotary compressor according to claim 2, wherein the displacement is in the range from 7.9 cc to 8.3 cc.

4. The rotary compressor according to claim 1, wherein the height of the cam is 12.8 mm or less.

5. The rotary compressor according to claim 1, comprising an oil selected from the group having a PAG type oil having a kinematic viscosity between 95 cSt at 40° C. and 105 cSt at 40° C., and a POE type oil having a kinematic viscosity between 60 cSt at 40° C. and 105 cSt at 40° C.

6. The rotary compressor according to claim 5, wherein an oil quantity of the oil in the compressor is between 150 cc and 210 cc.

7. The rotary compressor according to claim 1, wherein the rotary compressor is provided for use as a part of a heat pump.

8. A heat pump for a household appliance, comprising a compressor, a condenser, a restrictor, and an evaporator, wherein the compressor is a rotary compressor according to claim 1.

9. The heat pump according to claim 8, wherein a refrigerant used with the heat pump is a flammable refrigerant having a charge of 150 g or less.

10. The heat pump according to claim 9, wherein R290 is used as the refrigerant.

11. The heat pump according to claim 8, wherein R407C or R134a is used as the refrigerant.

12. A household appliance for a laundry care apparatus, comprising a heat pump, wherein the heat pump is a heat pump according to claim 8.

13. The household appliance according to claim 12 wherein the household appliance is the laundry care apparatus that comprises a tumble dryer function.

* * * * *